US005879815A

United States Patent [19]

Schotz

[11] Patent Number: 5,879,815

[45] Date of Patent: Mar. 9, 1999

[54] CHANNEL FOR FIRE DAMPER ASSEMBLY

[75] Inventor: Timothy J. Schotz, Rothschild, Wis.

[73] Assignee: Greenheck Fan Corporation, Schofield, Wis.

[21] Appl. No.: 801,050

[22] Filed: Feb. 14, 1997

Related U.S. Application Data

[60] Provisional application No. 60/011,694 Feb. 15, 1996.

[51] Int. Cl.[6] ..... B21C 1/00

[52] U.S. Cl. ..... 428/582; 428/577; 428/580; 428/121; 428/130; 428/542.8; 454/369; 220/62; 220/62.1

[58] Field of Search ..... 454/369; 428/119, 428/121, 122, 130, 595, 542.8, 577, 580, 582; 220/62, 62.1; 229/198, 198.1; 126/293

[56] References Cited

U.S. PATENT DOCUMENTS

| | | | |
|---|---|---|---|
| 1,177,410 | 3/1916 | Hatfield | 220/62 |
| 2,300,842 | 11/1942 | Leslie | 98/42 |
| 3,172,347 | 3/1965 | Johnson | 98/1 |
| 3,307,505 | 3/1967 | Windross | 108/111 |
| 3,800,846 | 4/1974 | Kurz | 160/35 |
| 4,304,427 | 12/1981 | McCabe | 285/331 |

OTHER PUBLICATIONS

A one–page written report of Tim J. Schotz dated Jan. 3, 1996 including a drawing entitled "Conventional Sleeve 'B' Channel", Fig. 1.

*Primary Examiner*—Ellis P. Robinson
*Assistant Examiner*—Jennifer M. Hayes
*Attorney, Agent, or Firm*—Quarles & Brady

[57] ABSTRACT

A B-channel for use in a damper frame or sleeve is disclosed which is formed from a blank of sheet metal. The blank has a rectangular barrier wall, a pair of side walls formed along two opposing edges and end walls formed along opposing edges of the barrier wall. The side walls and end walls are folded perpendicularly to the barrier wall and tabs are formed on the end walls to be folded into the planes of the side walls. The B-channel is particularly useful in conjunction with a fire damper sleeve.

4 Claims, 2 Drawing Sheets

FIG. 3
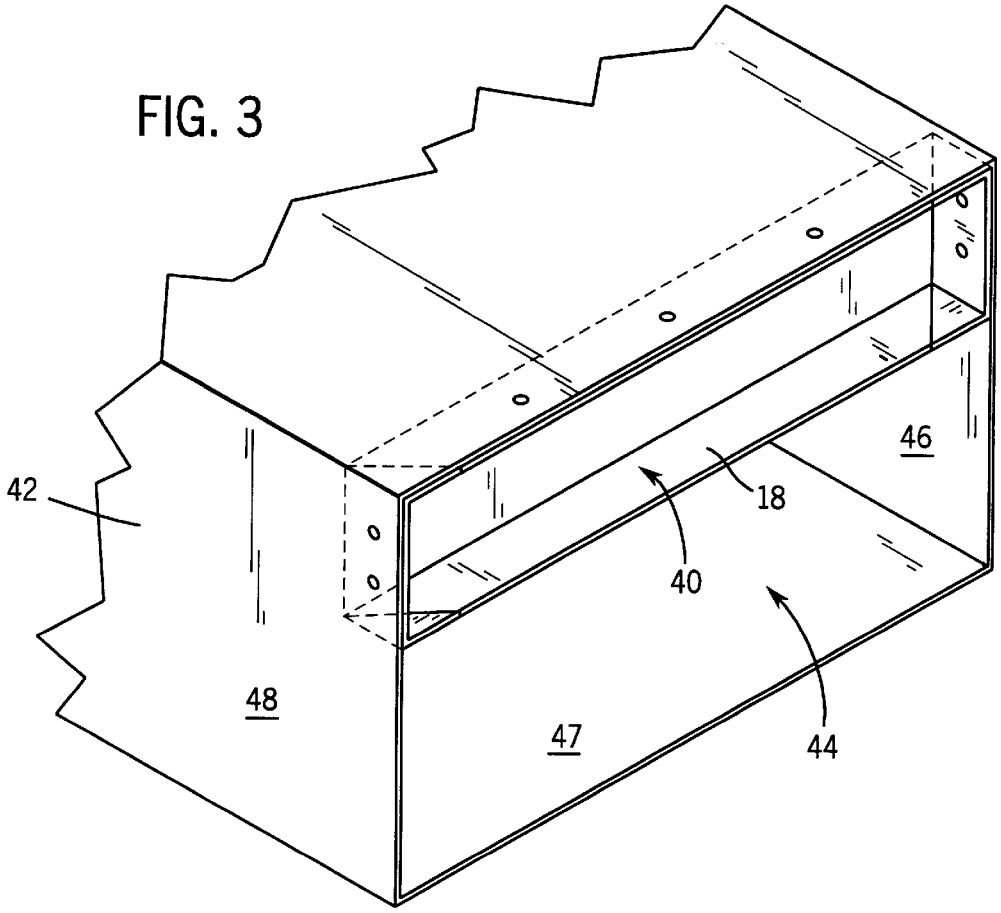
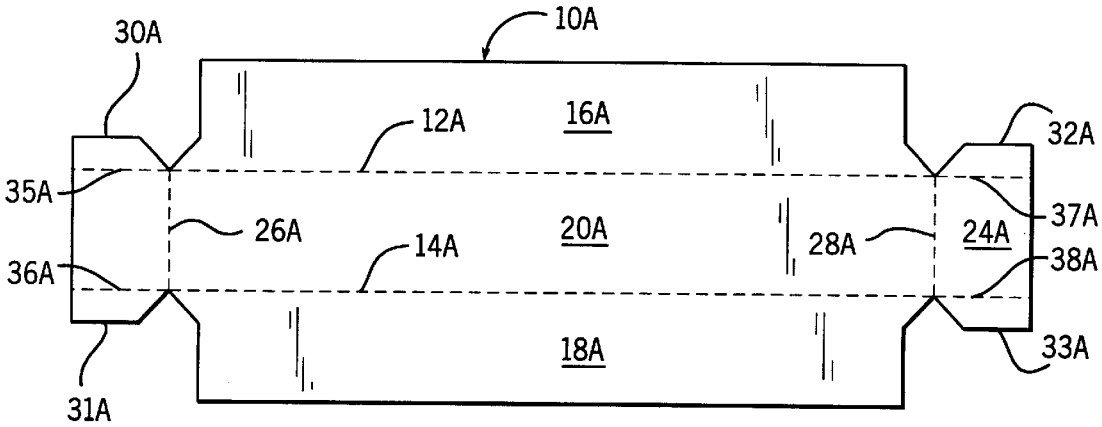
FIG. 4

CHANNEL FOR FIRE DAMPER ASSEMBLY

CROSS REFERENCES TO RELATED APPLICATIONS

This application is a continuation of a provisional application Ser. No. 60/011,694, filed Feb. 15, 1996.

STATEMENT REGARDING FEDERALLY SPONSORED RESEARCH

Not applicable.

BACKGROUND OF THE INVENTION

The field of the invention is duct work used in heating, ventilating and air conditioning systems ("HVAC") and particularly, channels for reducing the size of duct openings.

Fire damper assemblies are employed in duct work for HVAC systems at various locations. The damper assemblies include a sleeve which connects to the duct work, and the size of the sleeve is often larger than the duct work. A "B-channel" is attached to the damper sleeve to reduce its size to that of the duct work to be attached. Such B-channels are constructed from sheet metal which is bent to the desired channel shape and fastened to one wall of the sleeve. Caulking is used on the ends of the B-channel to completely seal off the interior and prevent air leakage.

SUMMARY OF THE INVENTION

The present invention is a B-channel for use in a damper frame such as a sleeve to reduce its size. It is constructed from a single piece of sheet metal that is formed to provide a rectangular barrier, a pair of contiguous side walls that extend substantially perpendicular from two opposing edges of the barrier, and a pair of contiguous end walls that extend substantially perpendicular from the other two opposing edges of the barrier.

A general object of the inventing is to minimize the gaps formed between the B-channel and the damper sleeve. The end walls and side walls are cut and folded such that their intersection lies in the plane of the side walls and is covered by the damper sleeve and attached duct work.

BRIEF DESCRIPTION OF THE DRAWINGS

FIG. 3 is a partial perspective view of the formed B-channel mounted in a damper sleeve; and FIG. 4 is a plan view of an alternative sheet metal blank.

DETAILED DESCRIPTION

Figure 1:
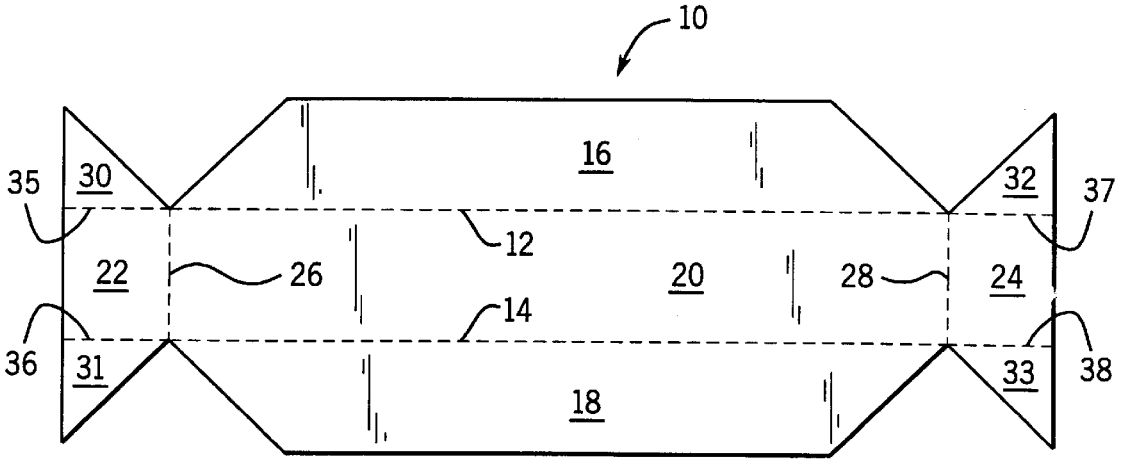
FIG. 1 is a plan view of the sheet metal blank used to form the preferred embodiment of the B-channel according to the present invention.

The preferred embodiment of the invention is formed from a sheet metal blank 10 of generally rectangular shape. The blank 10 is folded along parallel fold lines 12 and 14 to form a pair of side walls 16 and 18 that extend perpendicular from two opposing edges of a rectangular barrier wall 20. The ends of each side wall 16 and 18 are cut at an angle of 45° from the corner of the barrier wall 20. This can be done at any stage with respect to forming fold lines 12 and 14.

The blank 10 also includes a pair of end walls 22 and 24 which are folded along parallel fold lines 26 and 28. Triangular tabs 30–33 are formed at each end of the end walls 22 and 24 and these are folded along respective fold lines 35–38. The tabs 30–33 are cut at an angle of 45° such that when they are folded as shown, they mate with the angled ends of the side walls 16 and 18.

Figure 2:
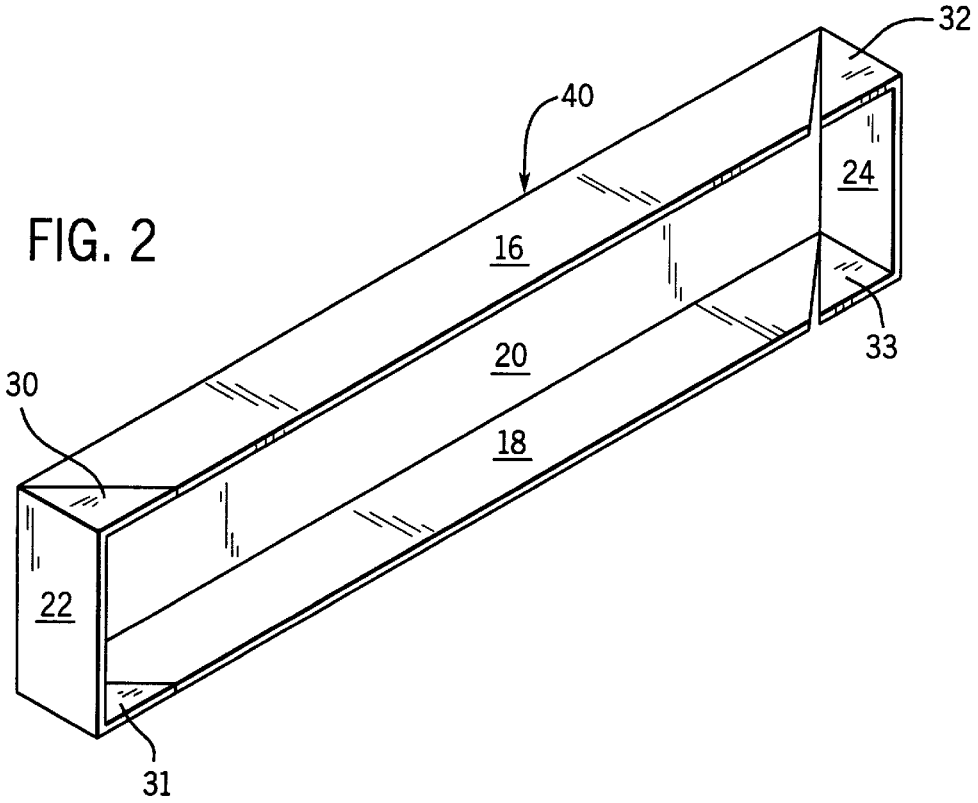
FIG. 2 is a perspective view of the formed B-channel.

As shown in FIG. 2, the folded blank 10 thus forms a B-channel 40 having a rectangular barrier wall 20 bounded by contiguous perpendicular walls 16, 18, 22 and 24. The only gaps in this structure occur along the angled intersections of the tabs 30–33 which lie in the planes of the side walls 16 and 18.

As shown in FIG. 3, the B-channel 40 is mounted in the rectangular opening of a damper frame or sleeve 42. One side wall 16 and both end walls 22 and 24 are fastened with rivets or screws to the damper sleeve 42. Welding could also be employed. A rectangular opening 44 of reduced size is thus formed in the end of the damper sleeve 42 and a mating duct (not shown) is inserted therein. The duct is fastened to the remaining side wall 18 of the B-channel 40 and the three mating walls 46–48 of the damper sleeve 42.

FIG. 4 shows an alternative embodiment 10A wherein the same numbers are employed to designate similar components except followed by an"A" suffix. This embodiment illustrates different geometric configurations for the tabs 30A–33A, as well as a different cutting angle with respect to walls 16, 18 and 20.

While the B-channel 40 can be employed in conjunction with any type of rectangular damper sleeve or frame, it has found to be particularly useful in conjunction with a fire damper sleeve.

What is claimed is:

1. A B-channel damper frame formed from a sheet metal blank having a rectangular barrier wall, a pair of side walls formed along two opposing edges of the barrier wall, and a pair of end walls formed along the two remaining edges of the barrier wall, wherein tabs are formed on said end walls, side walls and side end walls being folded substantially perpendicular to said barrier wall, and said end wall tabs being folded into the planes of said side walls to form contiguous substantially perpendicular walls so that the rectangular barrier wall is bounded by said contiguous substantially perpendicular walls.

2. The B-channel of claim 1, wherein the damper frame is a damper sleeve.

3. The B-channel of claim 2, wherein the B-channel is connected to a damper sleeve.

4. The B-channel of claim 3, wherein the damper sleeve is a fire damper sleeve.

* * * * *

UNITED STATES PATENT AND TRADEMARK OFFICE

CERTIFICATE OF CORRECTION

PATENT NO. : 5,879,815

DATED : March 9, 1999

INVENTOR(S) : Timothy J. Schotz

It is certified that error appears in the above-identified patent and that said Letters Patent is hereby corrected as shown below:

Claim 1, line 1
Column 2, line 40
After "B-Channel" "damper frame" should be deleted and --damper frame-- should be inserted before "B-channel".

Claim 1, line 6
Column 2, line 45
Before "side" --said-- should be inserted.

Claim 1, line 6
Column 2, line 6
Before "end walls" "side" should be deleted and --said-- should be inserted.

Signed and Sealed this

Twenty-third Day of November, 1999

*Attest:*

*Attesting Officer*

Q. TODD DICKINSON

*Acting Commissioner of Patents and Trademarks*